US006454054B1

(12) United States Patent
Tanino et al.

(10) Patent No.: US 6,454,054 B1
(45) Date of Patent: Sep. 24, 2002

(54) ELEVATOR WITH SEPARATED SPEED GOVERNOR AND POSITION DETECTOR

(75) Inventors: Junichi Tanino; Masao Shibata; Ichirou Satou, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/817,022

(22) Filed: Mar. 27, 2001

(30) Foreign Application Priority Data

Oct. 13, 2000 (JP) ..... 2000-314003

(51) Int. Cl.[7] ..... B66B 3/02
(52) U.S. Cl. ..... 187/394
(58) Field of Search ..... 187/351, 391, 187/393, 394, 373, 293; 324/166; 182/414

(56) References Cited

U.S. PATENT DOCUMENTS 4,134,476 A * 1/1979 Zolernovich et al. ..... 187/29 R
4,494,628 A * 1/1985 Uherek et al. ..... 187/29 R
5,458,216 A * 10/1995 Tanaka et al. ..... 187/373

FOREIGN PATENT DOCUMENTS

| | | | |
|---|---|---|---|
| JP | 60-93668 | 6/1985 | |
| JP | 4-323180 | * 11/1992 | ..... 187/394 |
| JP | 6-56367 | 5/1994 | |
| JP | 6-144734 | 5/1994 | |
| JP | 10-59639 | 3/1998 | |

* cited by examiner

*Primary Examiner*—Jonathan Salata
(74) *Attorney, Agent, or Firm*—Leydig, Voit & Mayer, Ltd.

(57) ABSTRACT

In an elevator, a transmission sheave is attached to a mount structure fastened to a guide rail. A speed governor rope suspended from a speed governor is coupled with an elevator car that ascends and descends in a shaft, and is wound on the transmission sheave. An idler pulley is provided for increasing a winding angle with respect to the transmission sheave by changing movement of the speed governor rope 4. A position detection apparatus is provided for detecting the position of the car in the shaft based upon the rotation of the transmission sheave. The position detection apparatus can be installed in an empty space in the shaft without the need of a repair of an existing speed governor to save the repair costs of the elevator.

9 Claims, 4 Drawing Sheets

ELEVATOR WITH SEPARATED SPEED GOVERNOR AND POSITION DETECTOR

BACKGROUND OF THE INVENTION

1. Field of the Invention

The present invention principally relates to a car position detector for an elevator additionally disposed thereon to improve control performance upon the repair of an existing elevator.

2. Background Art

Referring to FIG. 6, a prior art car position detector for an elevator is illustrated, which is similar to an arrangement disclosed in Japanese patent publication No. Hei. 6-144734for example. The figure is an elevation view for, illustrating conceptually the construction of a portion of the elevator wherein designated at 1 is a car ascending and descending along a predetermined passage of a shaft 2, and 3 is a speed governor, disposed toward an upper part of the shaft 2.

Designated at 4 is an endless speed governor rope wound around a speed regulation pulley of a speed governor 3 and suspended in the shaft 2 with one side coupled with the car 1 to move, following the descending and ascending of the car 1. Reference numeral 5 shows a tension pulley mounted on a lower suspended portion of the speed governor rope 4 astride the rope to provide tension to the speed governor rope 4. Reference numeral 6 is an encoder coupled with a rotary shaft of the speed governor 3, and 7 is a position detection circuit, into which an output of the encoder 6 is inputted to detect the ascent and descent position.

In the prior art car position detector of an elevator arranged as described above, the speed governor rope 4 is moved and follows the ascent/descent motion of the car 1 to rotate the speed governor 3. Through the operation of the encoder 4 caused by the rotation of the speed governor 3, the ascent/descent position of the car 1 is detected on the basis of an output of the position detection circuit 7. The elevator can be controlled through a control panel (not shown) based upon the detection of the position of the car 1.

In the prior art car position detector of the elevator as described above, since the encoder is coupled with the existing speed governor 3, upon a repair of an existing elevator it is necessary to reconstruct the existing speed governor 3 of an encoder-equipped speed governor or to provide an additional coupling apparatus for the encoder on the existing speed governor 3. The prior art car position detector thus suffers from difficulties that it requires much complicated labor and that the connection of the encoder 6 is difficult to achieve because the space in the machine chamber where the speed governor 3 is installed is limited.

SUMMARY OF THE INVENTION

In view of the aforementioned difficulties of the prior art, it is an object of the present invention to provide an elevator equipped with a car position detection apparatus in which position detection apparatus can be additionally provided without requiring any repair of an existing speed governor.

According to one aspect of the present invention, an elevator comprises: a guide rail vertically installed in a shaft; a mount structure fastened to said guide rail; a transmission sheave attached to said mount structure; a car moving along said guide rail; a speed governor installed at the upper end of the shaft; an speed governor rope suspended from said speed governor in said shaft in a circular fashion with its both ends coupled with said car, one side of said speed governor rope being wound on said transmission sheave; and a position detection apparatus actuated through rotation of said transmission sheave for detecting the position of said car.

In another aspect, in elevator, the mount structure is preferably disposed at the upper end of said shaft outside a path of said car.

In another aspect, the elevator preferably further comprises an adjustment plate attached to said mount structure, and an idler pulley attached to said adjustment plate, wherein said one side of the speed governor rope is wound on said idler pulley for adjusting a winding angle thereof with respect to said transmission sheave.

In another aspect, the elevator preferably further comprises a displaceable fastening apparatus for displaceably fastening an adjustment plate to said mount structure to displace the adjustment plate forward and backward with respect to said guide rail.

In the foregoing elevator, the mount structure may be disposed outside an elevation distance of the car at a final end of the shaft.

Also in the foregoing, there may be provided a position fastening apparatus for displaceably fastening an adjustment plate on which an idler roller is mounted in the direction thereof where it goes forward and backward with respect to the guide rail.

Further, in the foregoing there may be provided a on-car operation switch including an automated/manual changeover switch and a control board operable with actuation of the on-car operation for operating the car at a low speed to a position corresponding to the position detection apparatus disposed at an upper end of the shaft.

Other and further objects, features and advantages of the invention will appear more fully from the following description.

BRIEF DESCRIPTION OF THE DRAWINGS

The above and other objects, advantages and features of the present invention will be more apparent from the following description taken in conjunction with the accompanying drawings in which.

DESCRIPTION OF THE PREFERRED EMBODIMENT

Figure 1:
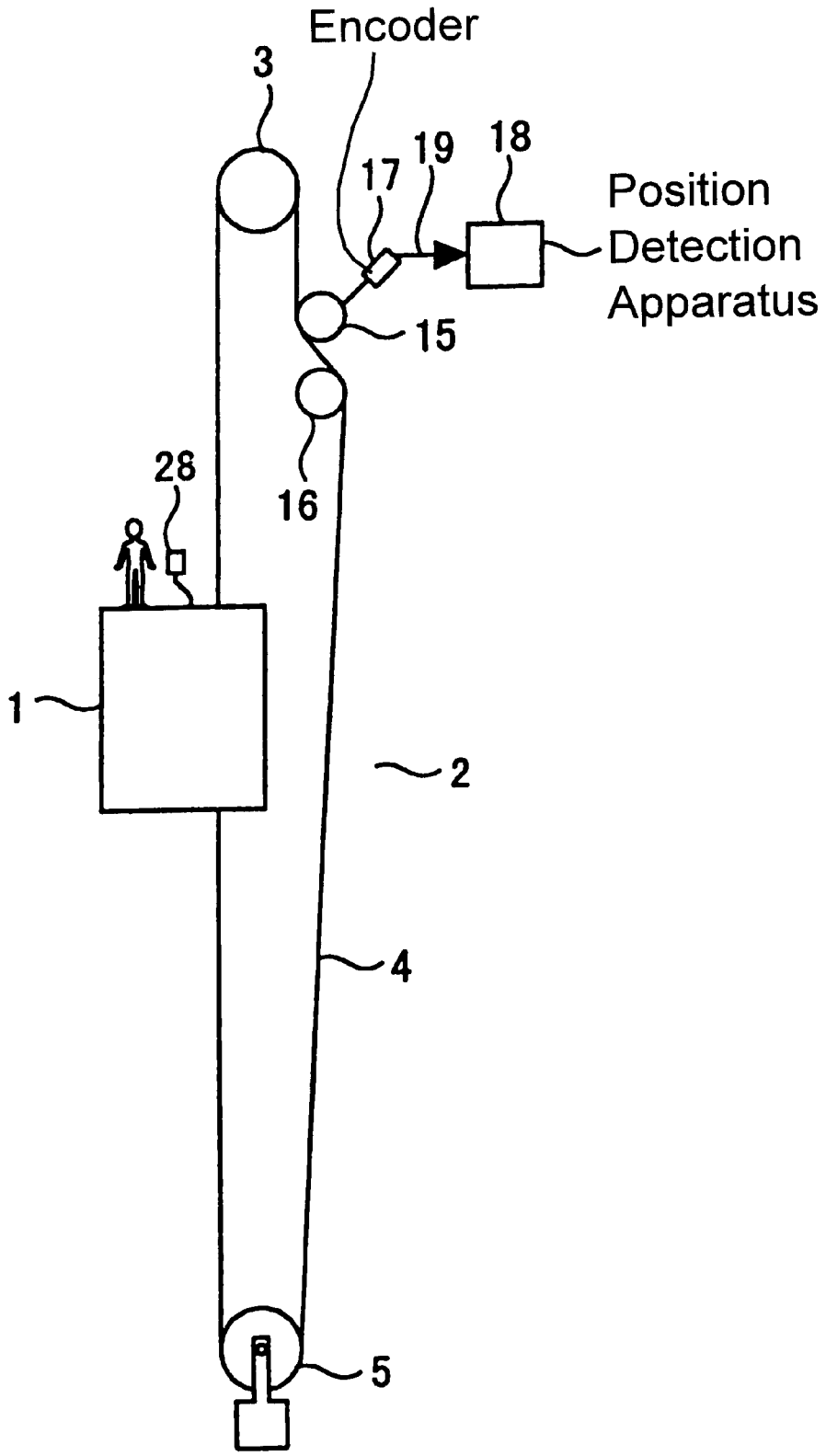
FIG. 1 is an elevation view of a first embodiment of the present invention schematically illustrating the construction of an elevator.
Figure 2:
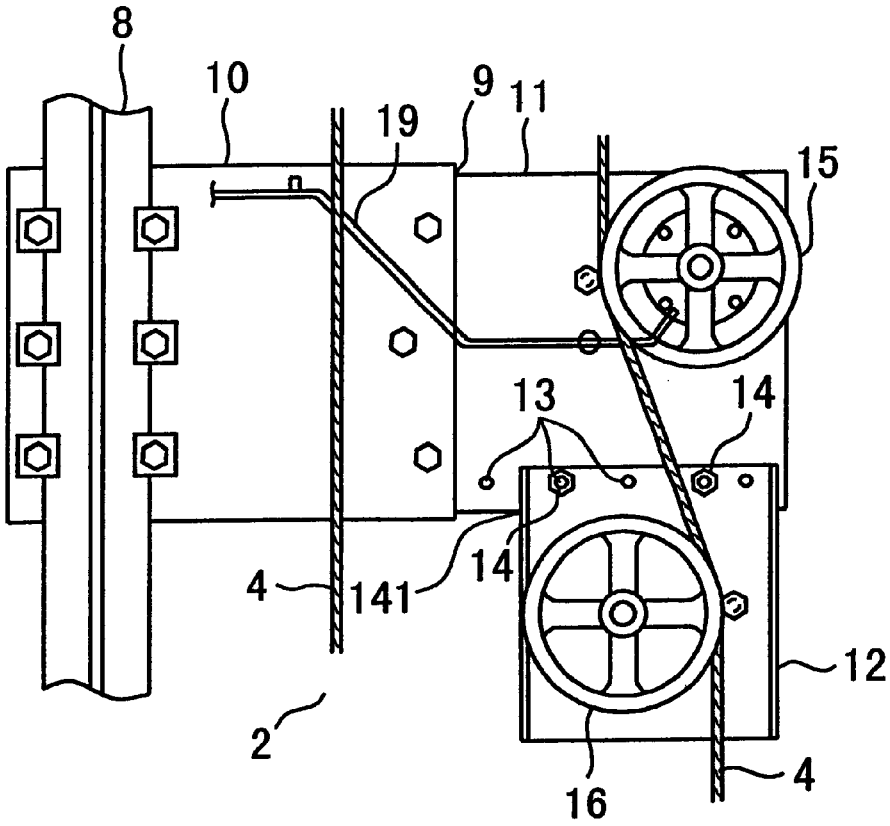
FIG. 2 is an enlarged view of a portion of a sheave in FIG. 1.
Figure 3:
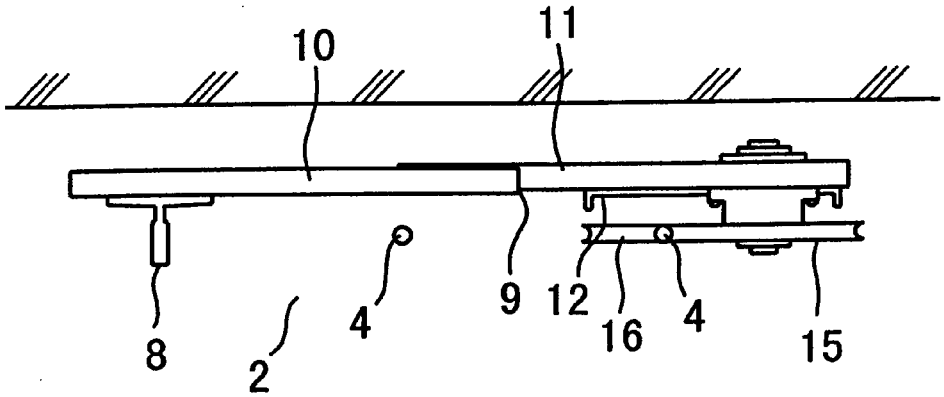
FIG. 3 is a plan view of FIG. 2.
Figure 4:
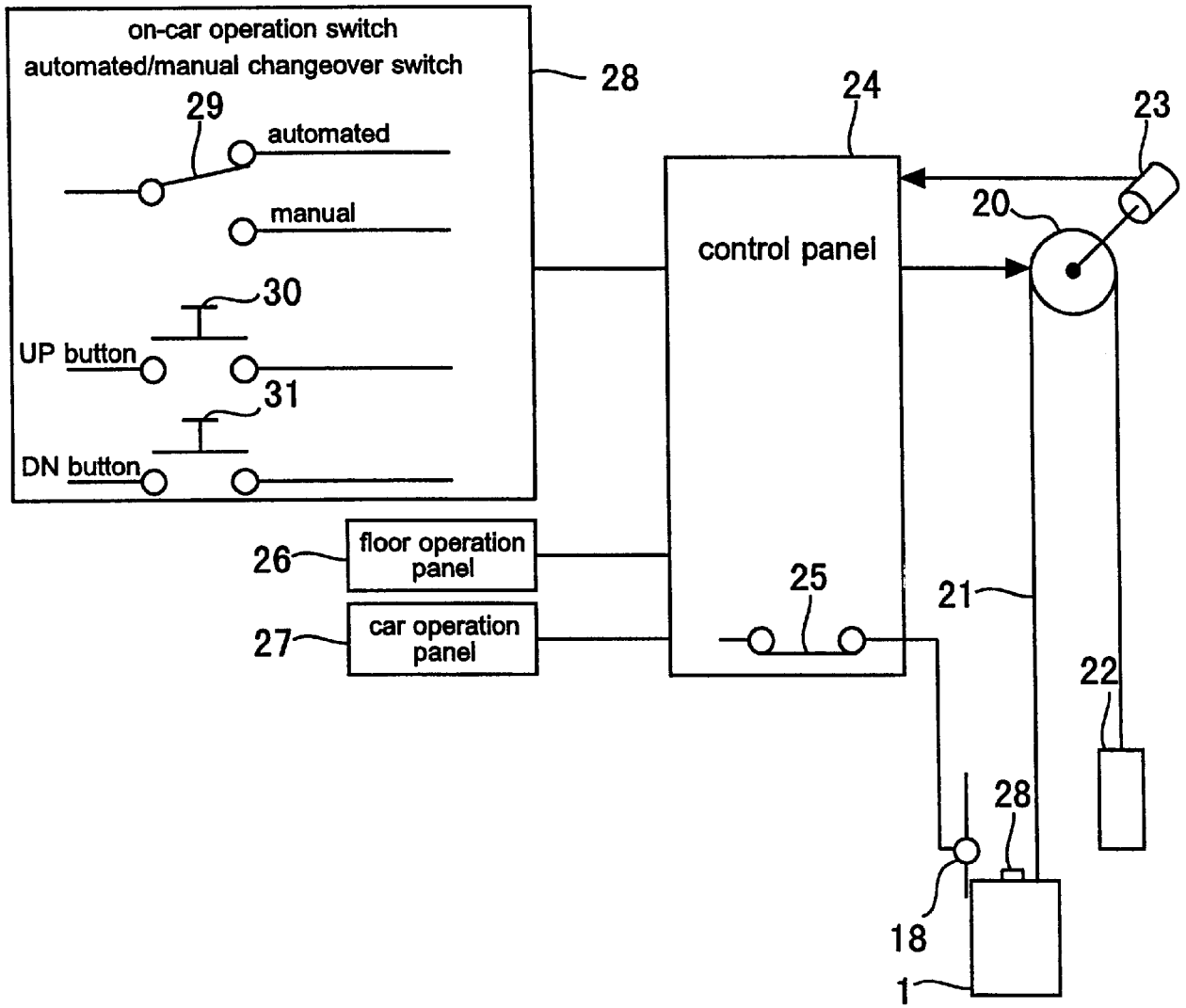
FIG. 4 is a circuit diagram illustrating a connection relation among various members in the elevator in FIG. 1.

In the following, a preferred embodiment of the present invention will be described with reference to the accompanying drawings.

Referring to the figures, designated at 1 is a car that ascends and descends along a predetermined passage of a shaft 2, and 3 is a speed governor disposed upward of the shaft 2.

4 is a speed governor rope of an endless type which rope is wound around a speed governor roller of the speed governor 3, and is suspended in the shaft 2 with its one side coupled with the car 1 for movement together with the ascend and descent motion of the car 1.

Designated at 5 is a tension roller for providing tension to the speed governor rope 4, and is provided at a lowest suspension bent portion of the speed governor rope 4 so as to stride the rope 4, and 8 is a guide rail provided vertically in the shaft 2, with which the car 1 is engaged elevatably for guiding the ascend and descend motion of the car 1.

There is further provided a mount structure 9 outside an elevation distance of the car 1 in the final end of the shaft 2, e.g., at an upper end of the shaft 2, which consists of a mount plate 10 with its one side fastened to the guide rail 8, and an attraction plate 11 with its one end fastened to an opposite guide rail 8 side of the mount plate 10. An adjustment plate 12 is fastened to the lower edge of the attraction plate 11 at its upper edge. Further, there are provided a plurality of fastening holes in the lower edge of the attraction plate 11, separated away from each other in the longitudinal direction.

There is further provided a fastening tool 14, which consists of a bolt passed through any of the upper edge of the adjustment plate 12 and the fastening holes 13, and a nut threaded into an insertion end of the bolt, and is disposed on the upper edge of the adjustment plate 12, separated to each other to fasten the adjustment plate 12 to the attraction plate 11. It is herein noticed that position of the adjustment plate 12 is adjusted with respect to the guide rail 8 in the direction thereof where it goes forward and backward by inserting the fastening tool 14 into any of the fastening hole 13.

Displaceable fastening apparatus 141 consists of the fastening holes 13 separately provided in the attraction plate 11 of the mount structure 9 and the fastening tool 14 threaded in the adjustment plate 12 and fitted to any of the fastening holes 13. A transmission sheave 15 is attached to the attraction plate 11, on which the speed governor rope 4 is wound.

An idler roller 16 is attached to the adjustment plate 12, and the speed governor rope 4 is wound on the idler roller 16. The position of the adjustment plate 12 is adjusted through the displaceable fastening apparatus 141 with respect to the guide rail 8 in the direction where it goes forward and backward, whereby a movement passage of the speed governor rope 4 is changed to alter the winding angle of the speed governor rope 4 with respect to the transmission sheave 15. It is noticed that there may be provided an idler pulley 16 to increase the winding angle of the speed governor rope 4 in an ordinary elevator.

An encoder 17 is coupled with and driven by a rotary shaft of the transmission sheave 15 and constructs a portion of position detection apparatus described later. The position detection apparatus 18 consists of the encoder 17 and a detection circuit for detecting the car 1 in the up and down directions of the shaft by permitting the operation of the encoder 17 to be inputted. A wiring 19 is to connect he encoder 17 and the position detection circuit.

The elevator includes a hoisting machine 20, on which a main rope 21 is wound with its one end coupled with the car 1 and the other end coupled with a counterweight 22. The hoisting machine 20 further includes a speed detector 23, which is energyzed with the operation of the hoisting machine 20.

The elevator further includes an elevator control panel 24, to which there are connected the position detection apparatus 18, the hoisting machine 20, and the speed detector 23. The elevator control panel 24 includes a contact 25 of a relief, cut-off relay provided on the control panel 24. A floor operation panel 26 is connected with the control panel 24, and a car operation panel 27 is connected with the control panel 24, and further an on-car operation switch 28 consists of an automated/manual changeover switch 29, an UP (ascend) button 30, and a DN (descend) button 31 all provided thereon.

In the car position detector arranged as described above, the speed governor rope 4 is moved following the ascend and descend of the car 1, whereby the speed governor 3 is rotated to detect an over speed of the car 1. Further, the transmission sheave 15 is driven and rotated following the movement of the speed governor rope 4 to operate the encoder 17. The ascent and descent distance of the car 1 is detected on the basis of an output of the position detection apparatus 18 through the operation of the encoder 17.

The elevator is controlled with the aid of a microcomputer on the control panel 24 through the position detection of the car 1 by the position detection apparatus 18. The transmission sheave 15 is attached, in an empty space at the upper end of the shaft 2, to the mount plate 10 of the mount structure 9 with its one side fastened to the guide rail 8.

It is therefore eliminated to reform an existing speed governor 3 to an encoder equipped one or to additionally process an existing speed governor 3, and since the mount structure 9 is disposed at an upper end of the shaft 2, i.e., within the shaft 2, there is eliminated restriction by a space as in the case where the position detection apparatus 18 is disposed in the machine chamber. It is accordingly facilitated to easily dispose the position detection apparatus 18 actuated by the rotation of the transmission sheave 15, and it is possible to save the refinement cost of the elevator.

The idler pulley 16 is attached to the adjustment plate 12 to adjust a remote/close position of the adjustment plate 12 from the guide rail 8. It is therefore possible to change the movement passage of the speed governor rope 4 with the aid of the idler pulley 16 to easily increase and decrease a winding angle of the speed governor rope 4 with respect to the transmission sheave 15. It is thus possible to easily set driving action of the transmission sheave 15 by the speed governor rope 4 to optimum conditions. This brings about normal operation of the encoder 17, whereby the operation of the elevator could be controlled through accurate position detection of the car 1.

In operation, for example in repair work of an elevator, the elevator is operated as follows, and there are installed the mount structure 9, the transmission sheave 15, the idler pulley 16, and the encoder 17, etc.

Figure 5:
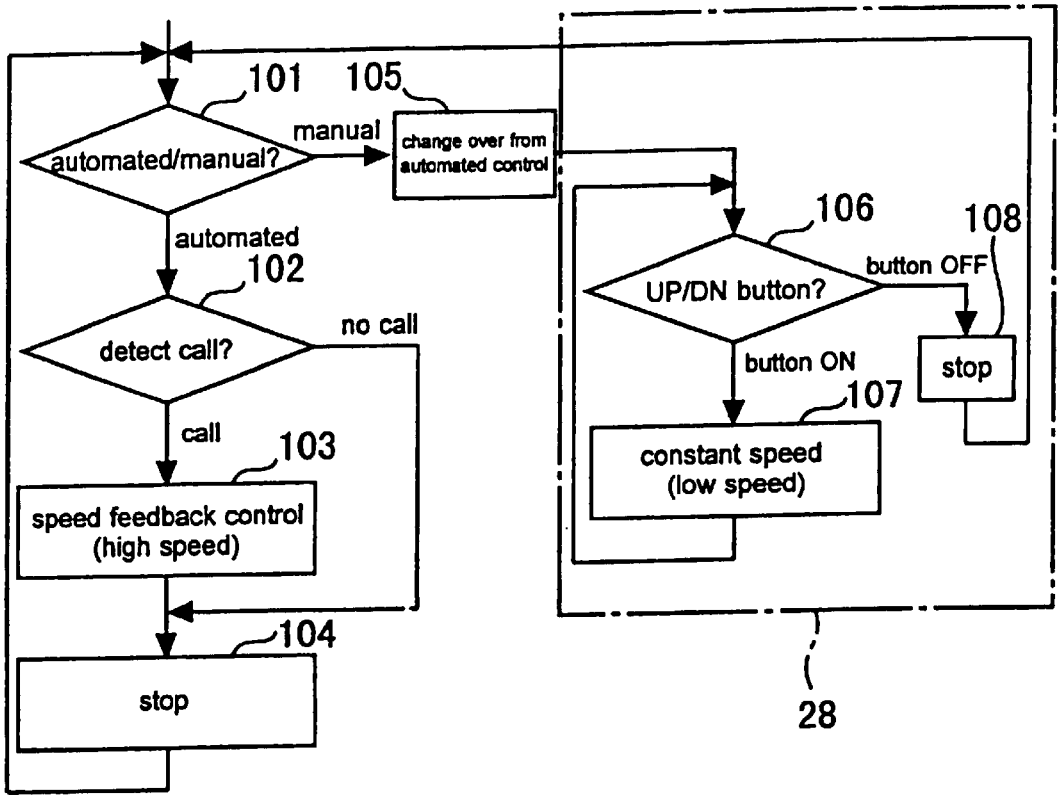
FIG. 5 is a flow chart illustrating an operation mode of the elevator in FIG. 1.
Figure 6:
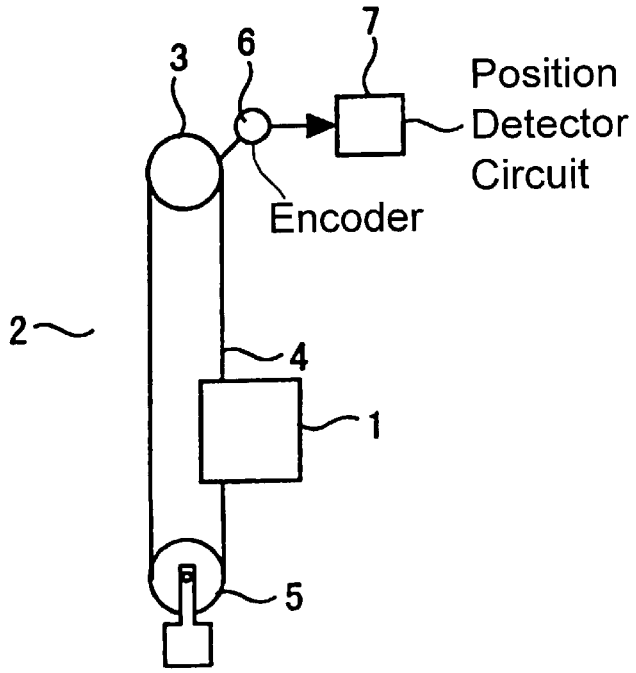
Fig. 6 PRIOR ART
FIG. 6 is an elevation view of a prior art car position detector for an elevator schematically illustrating the construction of a portion of an elevator.

Referring now to a flow chart of FIG. 5, the operation of the elevator will be first described. In step 101, an automated/manual changeover switch 29 is usually connected to an automated side. Then, the operation advances to step 102, and if there is any call, then the operation advances to step 103.

High speed operation by speed feedback control is executed in step 103, and when the elevator approaches a calling floor, the operation advances to step 104 where it is then interrupted. Further, the operation advances to step 102, where if there is no call, then it advances to step 104 and returns to step 101.

Upon the installation work of the aforesaid mount structure 9 and the like, in step 101 the automated/manual changeover switch 29 of the on-car operation switch 28 on the car 1 is connected with a manual side to advance the operation to step 105. In step 105, the elevator is changed over from the automated control to the manual control to advance the operation to step 106 where any of an UP (ascent) button 30 and a DN (descent) button 31 is operated, then the operation is advanced to step 107.

There is hereby performed the operation where the car 1 ascends or descends at a predetermined low speed in any direction of the operated UP (ascent) button 30 or DN (descent) button 31. Then, the operation is returned to step 106, and if there is released the operation to depress the UP(ascent) button 30 or the DN (descent), then the operation advances to step 108 to stop the car 1 and returns to step 101.

In succession, the car 1 is ascended at a low speed with manual control, and is interrupted near the upper end of the shaft 2 and installing work of the mount structure 9, etc., is achieved easily and effectively as the work on the car 1. Also upon maintenance and inspection works and the like for the transmission sheave 15, the idler pulley 16, and the encoder 17, etc., the car 1 is ascended with the manual control for works on the car 1.

When there are installed on the upper end of the shaft 2 the transmission sheave 15 and the position detection apparatus 18, etc., as described above, installing works of the transmission sheave 15 and the like, and maintenance work and inspection work could be easily achieved by forcing the car 1 to ascend through the automated/manual changeover switch 29 of the on-car operation switch 28, and efficiency of the installing work, etc., could be improved.

The features and the advantages of the present invention may be summarized as follows.

In accordance with the present invention, as described above, there are provided a car ascending and descending guided on a guide rail vertically provided in the shaft, an endless speed governor rope suspended in the shaft with its one side coupled with the car, and moving following the ascent and descent of the car, a transmission sheave attached to one side of a mount structure with the other side fastened to the guide rail, on which a speed governor rope is wound, an idler pulley attached to the mount structure, on which the speed governor rope is wound for increasing the angle of winding of the speed governor rope with respect to the transmission sheave by changing a movement passage of the speed governor rope, and position detection apparatus actuated through rotation of the transmission sheave for detecting the position of the car in vertical direction of the shaft.

With such a construction, the transmission sheave is attached, in an empty space in the shaft, to the mount structure with its one end fastened to the guide rail. Accordingly, there are eliminated the needs of refining an existing speed governor to the encoder-equipped speed governor and of additionally processing an existing speed governor. Further, since the mount structure is located at the upper end of the shaft, there is no limit to the installation space for the position detection apparatus as compared to the space in the machine chamber. The position detection apparatus operated by the rotation of the transmission sheave can thus be installed with ease to save the repair cost of the elevator.

Further, in accordance with the present invention as described above, the mount structure is disposed outside the ascent/descent distance of the shaft.

With such a construction, the transmission sheave is attached to the mount structure with its one side fastened to the guide rail in an empty space outside an ascent/descent distance of the car at a final end of the shaft. Accordingly, there are eliminated the needs of refining an existing speed governor to an encoder-equipped speed governor and of additionally processing an existing speed governor. Further, since the mount structure is disposed at the upper end of the shaft, there is no limit to the installation space for the position detection apparatus as compared to the space in the machine chamber. The position detection apparatus operated by the rotation of the transmission sheave can thus be installed with ease to save the repair cost of the elevator.

Furthermore, in accordance with the present invention as described above, the displaceable fastening apparatus is provided for displaceably fastening the adjustment plate, which forms a portion of the mount structure and to which the idler pulley is attached, in the direction where it goes forward and backward with respect to the guide rail.

With such a construction, the transmission sheave is attached, in the empty space on the shaft, to the mount structure of which one side is fastened to the guide rail. Accordingly, there are eliminated the needs of refining an existing speed governor to an encoder-equipped speed governor and of additionally processing an existing speed governor. Further, since the mount structure is disposed at the upper end of the shaft, there is no limit to the installation space for the position detection apparatus as compared to the space of the machine chamber. The position detection apparatus operated by the rotation of the transmission sheave can thus be installed with ease to save the repair cost of the elevator. Further, since the idler pulley is mounted through the displaceable fastening apparatus, driving action of the transmission sheave with the speed governor rope can be set to optimum conditions. The position detection apparatus can be correctly operated, and henceforth the operation of the elevator can be operated in a predetermined condition based upon accurate car position detection to stabilize the operation.

Further, in accordance with the present invention as described above, there are provided an on-car operation switch including the automated/manual changeover switch and a control panel operated following an input of the on-car operation switch to move the car at a low speed to a position corresponding to the position detection apparatus installed at the upper end of the shaft.

With such a construction, the transmission sheave is attached to the mount structure of which one side is fastened to the guide rail in an empty space on the shaft. Accordingly, there are eliminated the needs of refining an existing speed governor to an encoder-equipped speed governor and of additionally processing an existing speed governor. Further, since the mount structure is disposed at the upper end of the shaft, there is no limit to the installation space for the position detection apparatus as compared to the space of the machine chamber. The position detection apparatus operated by the rotation of the transmission sheave can thus be installed with ease to save the repair cost of the elevator. Further, when the transmission sheave and the position detection apparatus, etc., are installed at the upper end of the shaft, installing work for the transmission sheave, etc., and maintenance and inspection works could be easily achieved with ease on the car by forcing the car to ascend at a low speed through the automated/manual changeover switch of the on-car operation switch, to hereby improve the efficiency of the installation work.

Obviously many modifications and variations of the present invention are possible in the light of the above teachings. It is therefore to be understood that within the scope of the appended claims the invention may by practiced otherwise than as specifically described.

The entire disclosure of a Japanese Patent Application No. 2000-314003, filed on Oct. 13, 2000 including specification, claims, drawings and summary, on which the Convention priority of the present application is based, are incorporated herein by reference in its entirety.

What is claimed is:

1. An elevator comprising:

a guide rail vertically installed in a shaft;

a mounting structure fastened to said guide rail;

a transmission sheave attached to said mounting structure;

a car moving along said guide rail;

a speed governor installed at an upper end of said shaft and having a speed governor roller;

a speed governor rope having two ends, both ends being coupled to said car, a first portion of said speed governor rope being wound on said transmission sheave, and a second portion of said speed governor rope being wound on said speed governor roller; and a position detection apparatus actuated through rotation of said transmission sheave for detecting position of said car.

2. The elevator according to claim 1, wherein said mounting structure is disposed at the upper end of the shaft outside a path of said car.

3. The elevator according to claim 1, further comprising:

an adjustment plate attached to said mounting structure; and an idler pulley attached to said adjustment plate, wherein said first side of said speed governor rope is wound on said idler pulley for adjusting a winding angle of said idler pulley with respect to said transmission sheave.

4. The elevator according to claim 2, further comprising a displaceable fastening apparatus for displaceably fastening an adjustment plate to said mounting structure for forward and backward adjustment with respect to said guide rail.

5. The elevator according to claim 1, further comprising:

an on-car operation switch for automated and manual selection; and a control panel operated by an input of said on-car operation switch to operate said car at a low speed to move to a corresponding position of said position detection apparatus.

6. An elevator comprising:

a guide rail extending vertically in a hoistway;

a car moving along said guide rail;

a transmission sheave installed in said hoistway;

a speed governor installed in said hoistway at a different elevation from said transmission sheave and having a speed governor roller;

a speed governor rope having two ends, both ends being coupled to said car, a first portion of said speed governor rope being wound on said transmission sheave and a second portion of said speed governor rope being wound on said speed governor roller; and a position detection apparatus actuated through rotation of said transmission sheave for detecting position of said car.

7. The elevator according to claim 6, further comprising an idler pulley installed in said hoistway, a third portion of said speed governor rope being wound on said idler pulley, and wherein a winding angle of said speed governor rope with respect to said transmission sheave is increased by said idler pulley.

8. The elevator according to claim 7, further comprising, a mounting structure disposed in said hoistway, said transmission sheave being attached to said mounting structure; and an adjustment plate attached to said mounting structure and being adjustable a position of said adjustment plate with respect to said mounting structure, said idler pulley being attached to said adjustment plate.

9. The elevator according to claim 8, further comprising a displaceable fastening apparatus for displaceably fastening said adjustment plate to said mounting structure.

* * * * *